US007353646B1

(12) United States Patent
Copeland

(10) Patent No.: US 7,353,646 B1
(45) Date of Patent: Apr. 8, 2008

(54) CREEL ARM LATCHING DEVICE

(76) Inventor: Glen L. Copeland, 13338 Market St., Moulton, AL (US) 35650

( * ) Notice: Subject to any disclaimer, the term of this patent is extended or adjusted under 35 U.S.C. 154(b) by 100 days.

(21) Appl. No.: 11/408,778

(22) Filed: Apr. 21, 2006

Related U.S. Application Data

(60) Provisional application No. 60/673,693, filed on Apr. 21, 2005.

(51) Int. Cl.
*D01H 9/00* (2006.01)

(52) U.S. Cl. ..... 57/275; 57/112

(58) Field of Classification Search ..... 57/112, 57/136, 275, 281; 292/14, 44, 49; 242/131
See application file for complete search history.

(56) References Cited

U.S. PATENT DOCUMENTS 1,292,310 A * 1/1919 Gravel ..... 292/14
3,304,026 A * 2/1967 Bucklow et al. ..... 242/131
4,163,357 A * 8/1979 Greive et al. ..... 57/58.36
4,175,717 A * 11/1979 Mathiolon et al. ..... 242/131
4,180,967 A * 1/1980 Greive et al. ..... 57/66
4,240,594 A * 12/1980 David, Jr. ..... 242/131
4,464,891 A * 8/1984 Manly, Jr. ..... 57/90

* cited by examiner

*Primary Examiner*—Shaun R. Hurley
(74) *Attorney, Agent, or Firm*—Mark Clodfelter

(57) ABSTRACT

A latch member for a creel assembly is disclosed. The latch is constructed of a generally flat plate, with upstanding side entrance and exit portions. A V-shaped slot is provided in the flat portion of the plate, and a mount is provided at an upper end of the latch to allow the latch to hang freely and rotate in a plane, and be mounted to a support member of a creel assembly. A stub shaft is mounted in the plane to an adjacent support for the creel arm so that when the creel is lowered, the latch member falls upon the stub shaft, which enters the V-shaped slot. When an empty bobbin is replaced in the creel, the weight of the bobbin causes the latch member to disengage from the V-shaped slot.

18 Claims, 5 Drawing Sheets

CREEL ARM LATCHING DEVICE

CROSS REFERENCE TO RELATED APPLICATIONS

This application claims the benefit of provisional application No. 60/673,693, filed Apr. 21, 2005.

FIELD OF THE INVENTION

This invention relates to latching devices, and more particularly to latching devices for temporarily securing movable bobbin creels in a lowered position during placement of heavy thread bobbins on spindles carried by the creels.

BACKGROUND OF THE INVENTION

Certain cabling machines, notably cabling machines as disclosed in U.S. Pat. No. 4,932,198, filed Apr. 26, 1989 and which is incorporated herein by reference in its entirety, are provided with a plurality of cabling stations. Each cabling station has a bobbin creel assembly, with each bobbin creel assembly in turn having a creel support arm supporting the bobbin creel and associated spindles upon which cord or thread bobbins are mounted. A thread-combining machine that is part of a cabling machine is located beneath the bobbin creel, and receives a first cord or thread from a bobbin on the bobbin creel and a second cord or thread from a second bobbin located beneath the thread-combining machine. Because of the relatively high weight of bobbins filled with cord, the upper bobbin creel assemblies are designed with bobbin creel support arms or members pivotally mounted and enabled to be pulled downward to a location approximately chest high so as to minimize a height to which the loaded bobbins must be lifted by workers to be mounted on the spindles supported by the bobbin creel. As the weight of the bobbin creel assembly and bobbins loaded with cord is substantial, a gas strut similar to gas struts found on a rear hatch of hatchback vehicles is mounted to the bobbin creel assembly to apply a bias between members that support the bobbin creel assembly in such a way that assists in lifting the bobbin creel assembly with a loaded bobbin back into its upright operating position. An automatic latch is also provided on the bobbin creel support arms or support members to automatically latch the bobbin creel against the bias applied by the gas strut in its lowered position so that an empty or near-empty bobbin may be replaced without having to hold the bobbin creel assembly down against the bias of the gas strut.

As shown in FIG. 1*a*, an illustration of such a prior art automatic latch, latch member 1 is mounted to the creel support arm and latch member 2 is mounted to a support arm that causes latch member 2 to slide inwardly within a channel 3 when the bobbin creel is pulled downward to replace a bobbin. An arm 4 having a downwardly extending pin 5 on an end thereof is mounted so as to be stiffly movable in directions indicated by arrows. Within member 2, a combination of lands 7 directs pin 5 into slot A, as indicated by an arrow, when member 1 is pushed into member 2. This action occurs when the bobbin creel is pulled downward, the downward motion terminating when pin 5 bottoms out in slot A. When the bobbin creel is released, the gas strut biases the bobbin creel upward, moving pin 5 out of slot A and against a land 9, which guides pin 5 into a capture region as indicated by the dashed line showing of pin 5. After a full bobbin is loaded onto the bobbin creel, the bobbin creel is again pulled downward, causing pin 5 to ride against land 11 into slot 13, again terminating the downward motion of the bobbin creel. When such downward motion is terminated, the bobbin creel is released and pushed upward by combination of the bias of the gas strut and force applied by a worker, causing pin 5 to move out of slot 13 in the direction as indicated by the arrow against land 15, which serves to center pin 5 as shown along a longitudinal axis of member 1 in preparation for the next downward cycle of the bobbin creel.

While this latch functions for its intended purpose, i.e. to automatically lock the bobbin creel in its lowered position and unlock the creel responsive to weight of a full bobbin, it is expensive to manufacture and contains relatively delicate parts that are prone to breakage and bending, particularly when the bobbin creel is lowered with excessive force. In addition, this latching device is prone to jamming, particularly after parts become worn. When this occurs, it is a natural inclination to bang the bobbin creel alternately up and down in an effort to free the latch, this effort usually breaking parts in the latch. As such, this latch must be frequently replaced.

In accordance with the foregoing, a need exists for an automatic latching device for a bobbin creel assembly or other assembly, and which is sturdy of construction and not prone to breakage, is less expensive to manufacture or fabricate and which functions in a simpler and more reliable manner.

SUMMARY OF THE INVENTION

The present invention is directed to an improved latching device, and which may be easily mounted as a replacement for previously used latching devices. The new latch may take the form of an elongated plate mounted to a movable, biased first support member and pivotally held at a position near its top. The plate has a generally V-shaped slot defined across a middle portion thereof, providing a path for passage across the plate for a latch pin located on a second support member. The slot has a central portion wherein the latch pin is temporarily held stationary against the bias until the first support member is moved against the bias. At this point the latch pin traverses the remainder of the slot, and the plate is released and allowed to return to its original position. Both the initial locking position of the plate and its release are determined by movement of the latch member with respect to the latch pin and direction of the bias.

DETAILED DESCRIPTION OF THE DRAWINGS

Figure 1:
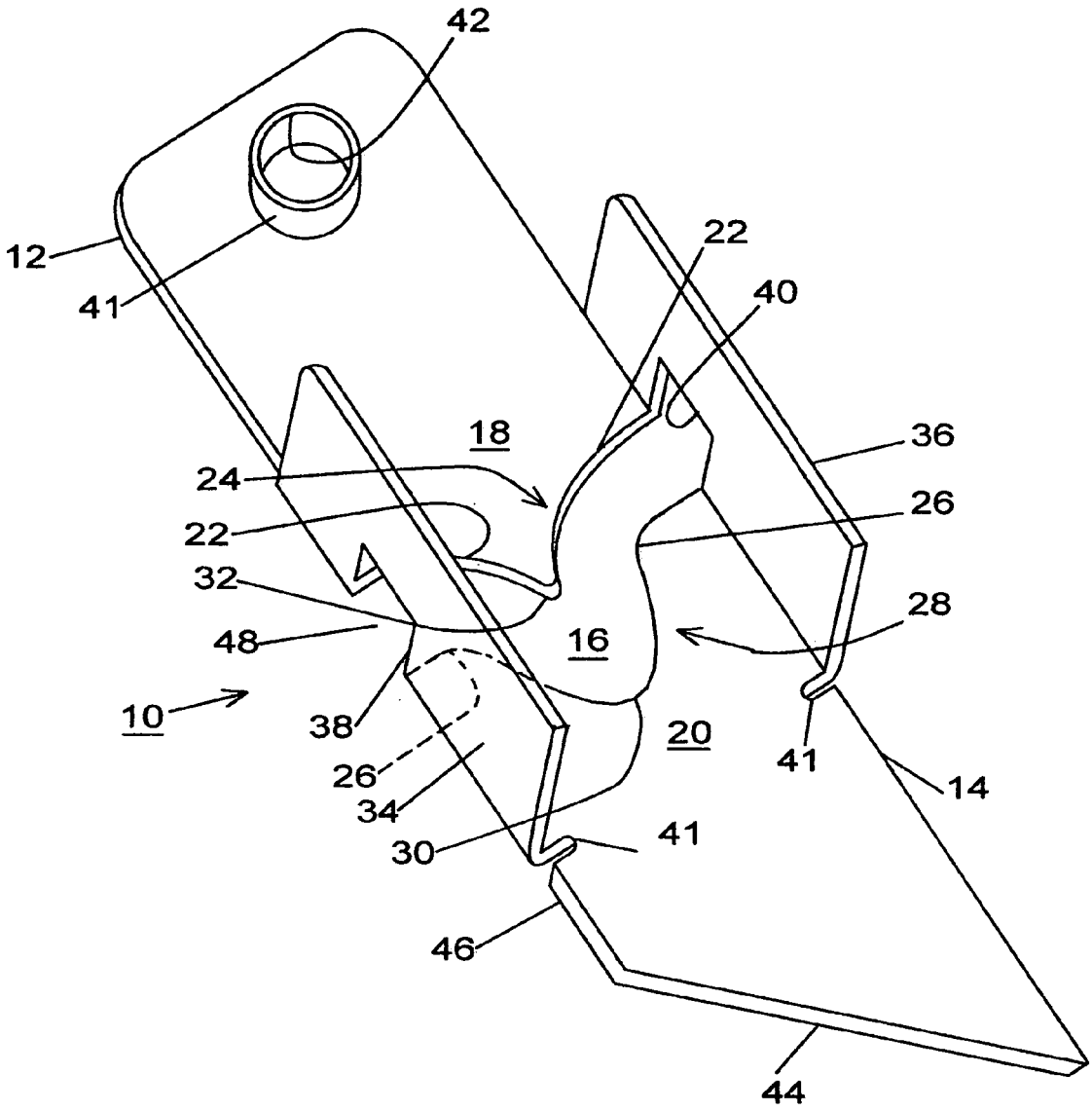
FIG. 1 is a perspective view of the latching device.
Figure 1A:
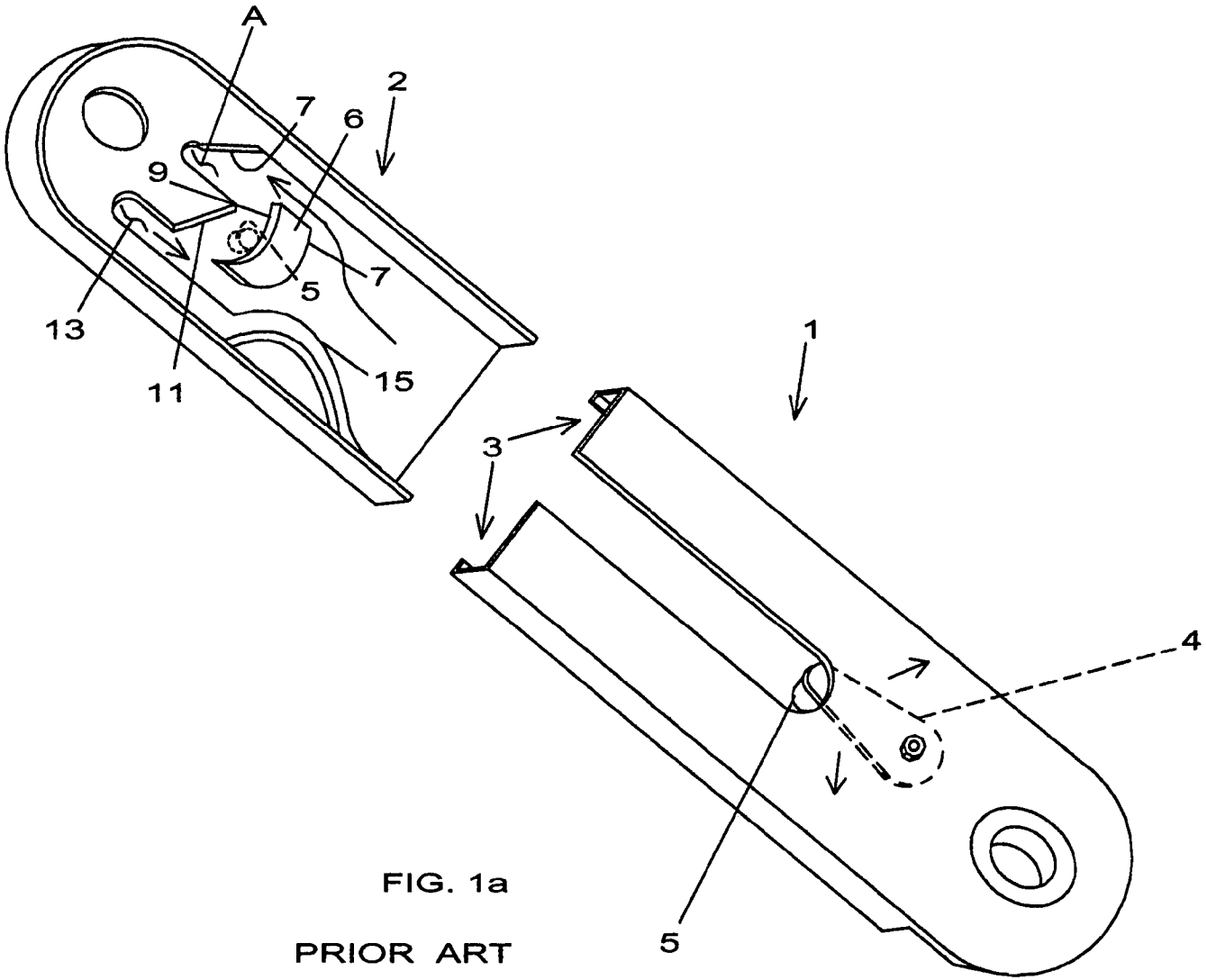
FIG. 1a PRIOR ART
FIG. 1*a* is a perspective view illustrating a prior art automatic latch.

Referring to FIG. 1 of the drawings, there is shown a relatively flat, elongated latch member 10 having an upper end 12 and a lower end 14. In the instant application, latch 30 may be fabricated from a relatively thick sheet metal, which may be on the order of about ⅛ to 3/16 inch, and which may be about 9 to 12 inches or so in length. Such construction provides a high level of durability, along with sufficient weight so that gravity causes the latch to maintain a generally vertical orientation to facilitate its operation, as will be further explained. Of course, other dimensions for a latch as disclosed may also be used as should be apparent by one skilled in the relevant arts.

Figure 1B:
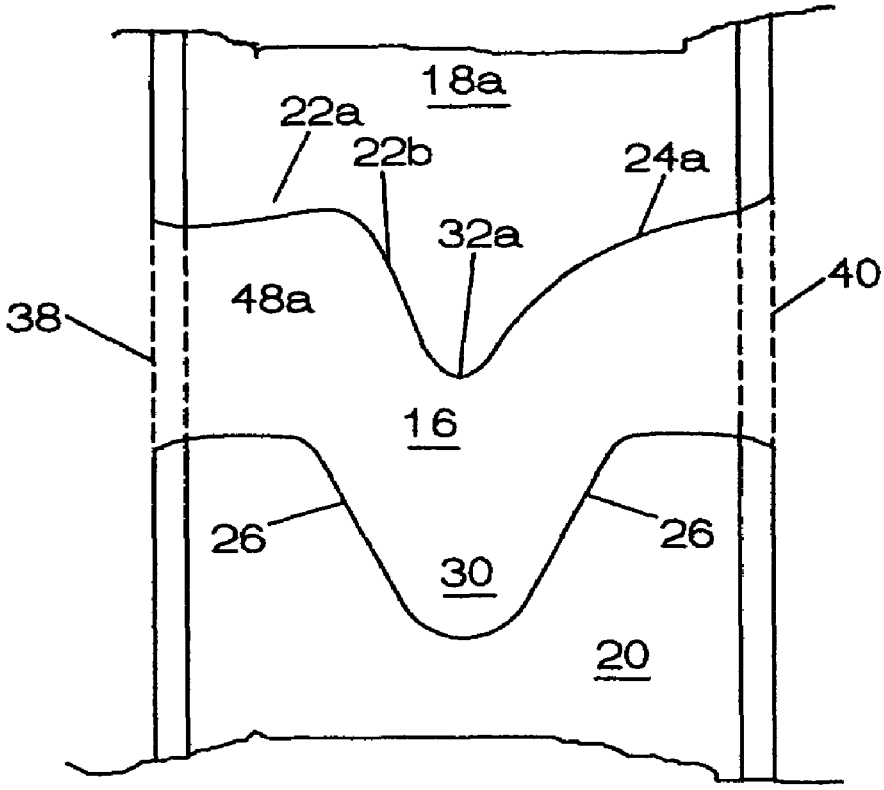
FIG. 1*b* is an illustration of a profile of a slot of the instant invention

A generally V-shaped latch or latching slot 16 may be located generally in a middle region of latch member 10, and extends the width of latch 10, dividing latch 10 into an upper portion 18 and a lower portion 20, as more particularly shown in FIG. 1*b*. Edges of the slot cooperate with the bias applied by the gas strut to capture a slot-engaging member. As shown, slot 16 may be configured having inwardly and upwardly curved edges 22 (FIG. 1) on upper portion 18 of slot 16, and inwardly curved edges 26 on lower portion 20 of slot 16. On edges 28 of lower portion 20, a rounded region 30 may be provided generally at the bottom of the V of the V-shaped slot, and on edges 24 a relatively sharp point 32 may be formed at the bottom of the V. As shown in FIG. 1*b* wherein dissimilar components are designated with the suffix "a", point 32 of FIG. 1 may be more rounded, as shown by point 32*a* in FIG. 1*b*. In addition, while slot 16 may be generally symmetrical as shown in FIG. 1, the slot may be asymmetrically optimized as shown in FIG. 1*b* by constructing the entrance leg initially generally normal to latch 10 so that a relatively straight edge 22*a* directs a slot-engaging member in a direction normal to latch 10. This edge transitions to edge 22*b* that is also straight and angled downward toward capture region 30. Edge 24*a* of the exit leg is constructed to have a lessor, slightly upward curvature, for reasons for which will become apparent hereinafter. While such curved configurations for the slot is shown, it should be apparent that such edges of the V-shaped slot may be formed without such curves in other embodiments of the invention. Here, edges of the slot may simply be formed in the shape of a V, with a respective entrance opening formed at the tops of the legs of the V-shaped slot. Also, size of the circular region 30 may be varied from a size generally as shown down to a point similar to point 32.

For connecting the upper portion 18 and lower portion 20 of the latch member, entrance side 34 and exit side 36 are formed perpendicular to planar portions 18, 20 containing V-shaped slot 16. An entrance clearance region or opening 38 is formed into side 34, and an exit clearance region or opening 40 is formed in exit side 36, these clearance regions communicating with upper ends of respective entrance and exit legs of V-shaped slot 16. These clearance regions permit passage of a slot-engaging member through slot 16 to effect a latched state of the latching member, also as will be further explained. As should be apparent, the latch may be stamped from a sheet material, and entrance and exit sides 34, 36 bent upward. Relief slots 41 may be provided where sides 34, 36 are bent upward so as to provide a generally smooth edge 46 along at least a side of the latch along which the slot-engaging member moves.

Latching member 10 is mounted at its upper end 12 by a mount so as to freely swing in a plane parallel to planar portions 18, 20, and as stated above, may be maintained or hung in a generally vertical orientation by gravity. In some applications where significant loading is placed on the latch, the mount may comprise an antifriction bearing or bushing (not shown) mounted in a bearing carrier 41 having an aperture 42 for receiving the bearing or bushing, carrier 41 located at upper end 12 of the latch. The antifriction bearing or bushing engages a respective shaft or pin in or mounted to an arm or other member to be latched or locked in place. In such instances where loading is not as severe, aperture 42 may be constructed smaller and without a bearing or bushing carrier, the latch member mounted at its upper end 12 to a shaft or pin, such as a shank portion of a screw or bolt. In yet another embodiment, upper end 12 may have a pin or shaft extending therefrom and which is rotatably fitted into an opening in a member to which the latch is mounted, and the opening may be fitted with an antifriction bearing or bushing. As stated, this method of mounting is significant in that it allows the latching member to swing freely in a plane parallel to the latch in general and particularly with respect to planar upper and lower portions 18, 20 during movements of an arm or other member to which the latch or latching member is mounted. While the instant application envisions the latch to be used in conjunction with a bobbin creel assembly, it should be apparent that the latch has other applications with other assemblies, such as to hold an upwardly swinging door or cover in an open position. In this application, gravity may provide a bias for the latch. Particularly, Applicant's latch is useful in applications where an assembly used in a product fabrication process is biased to an operative position, the assembly loaded with or holding a consumable used in the fabrication process. When the consumable becomes depleted, the assembly is moved against the bias and automatically latched so that the consumable may be replaced. Weight of the replaced consumable causes automatic unlatching of the assembly, allowing the assembly to be moved back into its operating position, which may be an upright position.

The bottom end 14 of latching member 10 may be provided with a diagonal edge 44 which serves as a camming edge against which a slot-engaging member first comes into contact with latching member 10. The slot-engaging member, being fixed, exerts a camming action against diagonal edge 44 to move latching member 10 to the right and allow the slot-engaging member to move along edge 44 and subsequently along edge 46. When the slot-engaging member reaches entrance opening 38, the latching member, under influence of gravity, swings downward, causing the slot-engaging member to enter entrance leg 48 of slot 16 (leg 48*a* in FIG. 1*b*) and be directed into circular region 30 by edge 32 (32*a* in FIG. 1*b*) as the assembly to which the slot-engaging member is attached is released to be biased upward. The slot-engaging member, being sized in diameter slightly smaller than the legs of slot 16, is held in position in circular region 30 by a combination of point 32 and a bias applied to the slot-engaging member, as will become apparent from the following discussion. The slot-engaging member may be a stub shaft, a relatively large diameter pin, a shaft having an anti-friction bearing sized slightly smaller than width of slot 16, or any other structure that may be used in conjunction with Applicant's latching member and function generally as described herein, and is referred to hereinafter as a stub shaft. Significantly, when the latching member falls onto the stub shaft, as when the stub shaft enters the entrance opening, further downward motion of the assembly is prevented. Thus, a positive stop against downward movement for the assembly is provided.

Figure 2:
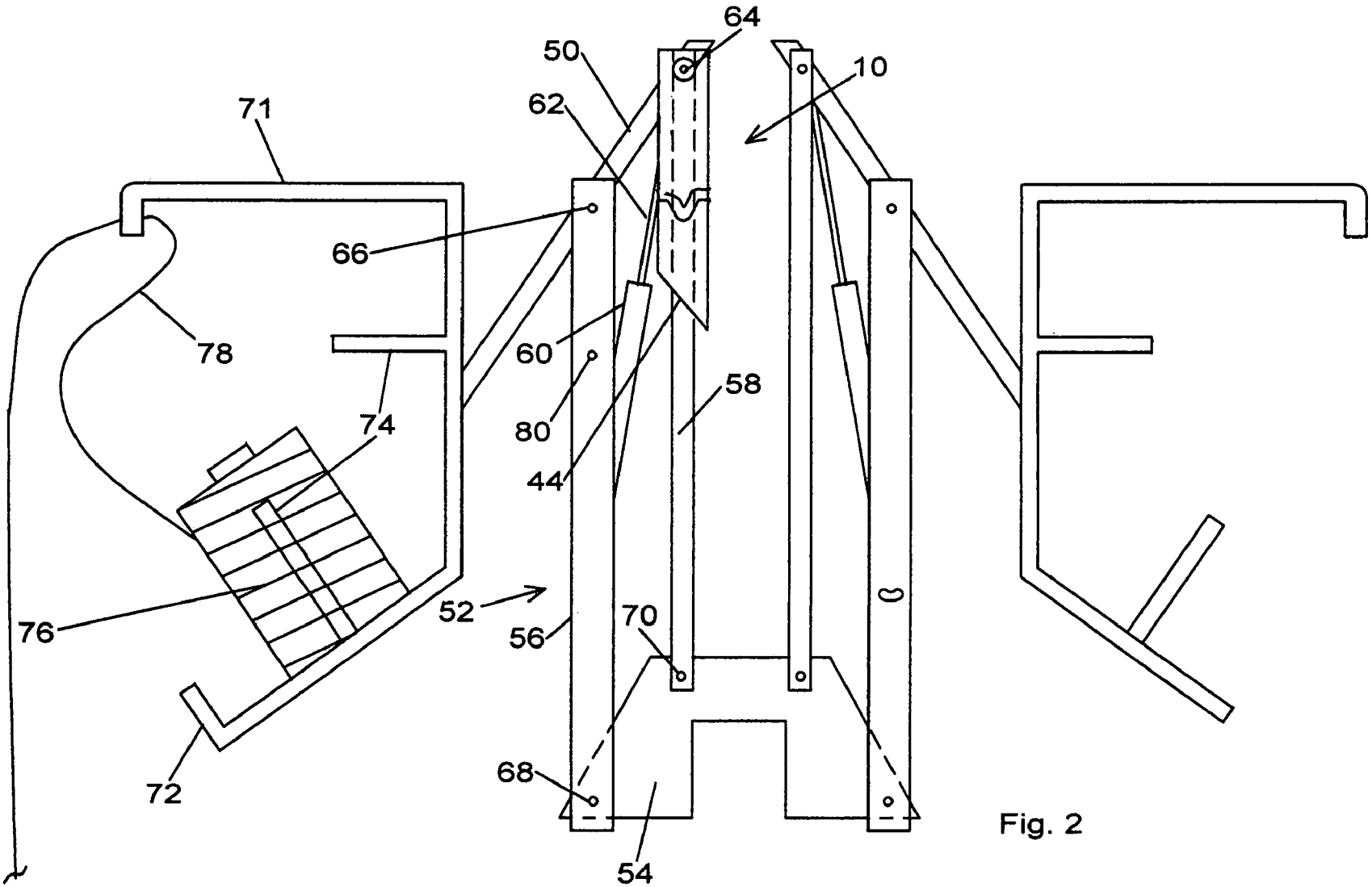
FIG. 2 is a side view of a bobbin creel in its upper, operating position showing installation of a latching device of the instant invention.

In one contemplated, primary use of Applicant's latching member, and by way of example only, FIG. 2 shows latching member 10 deployed or mounted to a bobbin creel assembly in turn constructed on top of a cabling machine as particularly described in the incorporated patent. Latching member 10, shown exaggerated in size in FIG. 2, is rotatably or pivotally mounted to rotate or move about the mount in a plane parallel to flat portions 18, 20 of the latch at an upper end of a pivoting creel arm 50. Arm 50 is part of a pivoting support assembly 52 mounted to a base 54, and which includes vertically extending support members 56, 58. Members 56, 58 are all pivotally mounted to base 54, and are pivotally connected at upper ends to creel arm 50. A compressible gas strut 60 may be used to bias assembly 52 into the upright position shown in FIG. 2 by virtue of its strut 62, which telescopes into cylinder 60 against the bias of gas therein, being pivotally connected at its upper end to pivoting connection 64 to which creel arm 50 and support member 58 and latch 10 are attached As such, connections 64, 66, 68 and 70 are all pivoting connections that allow assembly 52 to swing downward and to the left against the bias of gas strut 60, which applies the bias between members 56, 58. This movement is facilitated by a handle 72 that may be gripped by a worker and pulled downward to effect this movement of assembly 52. Also mounted to creel arm 50 is a bobbin support assembly 71 that includes a pair of spindles 74 to which bobbins 76 of heavy cord or thread are mounted, with cord or thread 78 from bobbin 76 shown being routed to the cabling machine. A stub shaft or latch pin 80 is fixedly mounted generally as shown on support member 56, and engages edge 44 of latch member 10 as previously described when bobbin creel 52 is pulled downward by applying a downward force to handle 72. In other applications, a spring may be used instead of a gas cylinder to apply bias between members to be latched.

Figure 3:
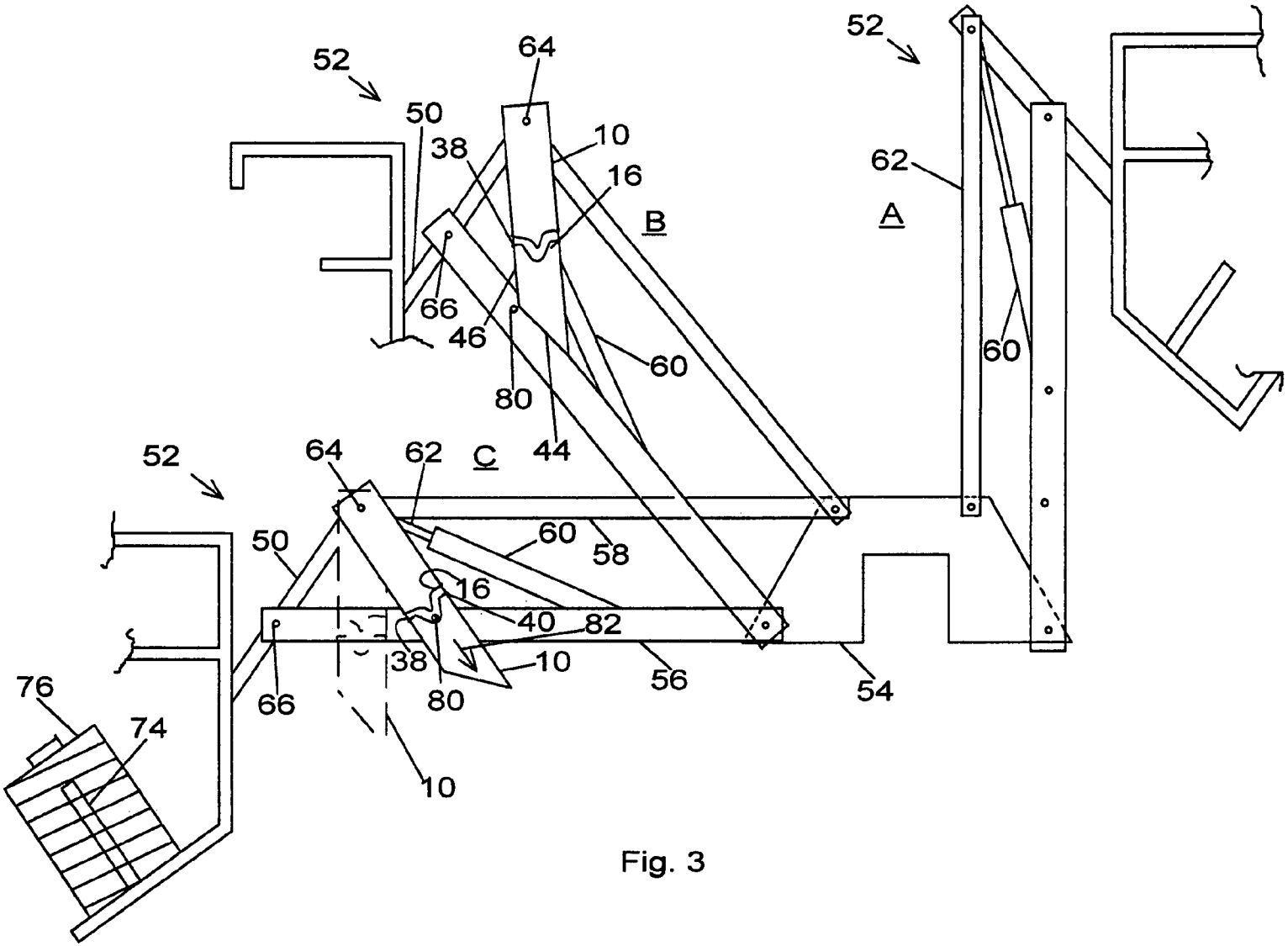
FIG. 3 is a side view of a bobbin creel in positions illustrating operation of the latching device of the instant invention.

FIG. 3 depicts positions of bobbin creel assembly 52, its various support arms or members and the latching device 10 as creel assembly 52 is moved through a cycle in which creel 52 is pulled downward and to the left to facilitate replacement of empty bobbins 76 onto spindles 74. Position A (shown in FIG. 2) is a starting position wherein creel 52 is upright, position B is an intermediate position, and position C is a position where creel 52 is locked in a lowered position so that empty bobbins may be replaced on spindles 74 with full or loaded bobbins. As in FIG. 2, size of latching member 10 is exaggerated for clarity, and portions of structure 52 are broken away for clarity. As creel arm 50 is pulled down against the bias applied by gas cylinder 60 and strut 62, a distance between diagonal edge 44 and stub shaft or latch pin 80 becomes closer as creel arm 50 is pulled down. At position B the diagonal bottom edge 44 of latching member 10 has moved into contact with stub shaft 80 and the stub shaft has moved latching member 10 into a diagonal position. At this point, the stub shaft is in position to move upward along side edge 46 as latching member 10 lowers until the stub shaft reaches entrance opening 38 of the entrance leg of slot 16. When the bobbin creel is pulled all the way down the latching member 10 engages the stub shaft at slot entrance 38, and gravity causes the latching member 10 to fall at edge 32 on stub shaft 80 and move into the C position. At this point, a worker may observe that the latch is engaged or feel downward motion of the creel assembly terminate, and release the creel assembly. When the creel assembly is released, the bias applied by gas cylinder 60 and strut 62 to the trapezoidal structure formed by creel arm 50, support members 56, 58 and base 54 is such that stub shaft 80 is held in generally circular capture region 30 (FIGS. 1, 1*b*) of latch member 10 by such bias, locking the entire structure in the lowered position C shown in FIG. 3. With respect to FIG. 1*b*, it is seen that the more abrupt curvature of edge 21*a* provides a more positive stop for the stub shaft as latching member 10 falls against the stub shaft so that when the creel is released, the stub shaft moves directly into capture region 30. The strength of the bias applied by gas cylinder 60 and strut 62 between the support members is such that when bobbin 76 is empty, the bias overcomes weight of creel assembly 52, tending to force creel 52 into the upright, operating position shown in FIG. 2 by leverage between connection point 66 and the pivoting end 64 of creel arm 50 to which strut 62 applies the bias. With this construction, and given the construction of latch 10, it should be apparent from FIG. 3 that the orientation of V-shaped slot 16 is such that stub shaft 80 is trapped in capture region 30 (FIG. 1) by a force vector extending in a direction indicated by arrow 82 when bobbin 76 is empty and creel assembly 52 is locked in position C by latch 10.

When a replacement bobbin 76 of sufficient weight, i.e. filled with thread or cord, is loaded onto spindle 74, the extra weight of the full bobbin overcomes the bias applied by gas cylinder 60 and strut 62, and creel assembly 52 drops or falls downward a slight distance. This fall or drop of creel 52 causes latching member 10, under the influence of gravity, to be released from capture region 30 and swing to the left to the dashed line position as shown in FIG. 3. Here, stub shaft 80 moves through the exit leg of V-shaped slot 16 and through exit opening 40, thereby automatically disengaging the latched state of creel assembly 52. Thus, stub shaft 80 moves through the right-hand exit leg of V-shaped slot 16 and through opening 40 concurrently with the drop or lowering of creel 52 and the subsequent swing of latch member 10 to the left by gravitational force. With respect to FIG. 1*b*, it should be apparent that the lessor curvature of edge 24*a* of the exit leg smoothly facilitates the swing of member 10 concurrent with the drop of creel 52 in order to release the stub shaft. Creel 52, with the full bobbin on spindle 74, may then be raised, as by handle 72, to its operational position as shown in FIG. 2.

Having thus described my invention and the manner of its use, it should be apparent to those skilled in the appropriate arts that incidental changes may be made thereto that fairly fall within the scope of the appended claims,

Wherein I claim:

1. A latch comprising;

a first member and a second member to be engaged in latched relation, with a bias applied between said first member and said second member, a latch-engaging member mounted to one of said first member and said second member, a latching member mounted to the other of said first member and said second member, said latching member further comprising;

an elongated, generally flat plate having a latch slot therein, said latch slot extending a width of said generally flat plate and separating said generally flat plate into an upper portion and a lower portion, said latch slot having edges configured for cooperating with said bias and moving said latching member to capture said latch-engaging member, an entrance side member having an entrance opening communicating with said latch slot and an exit side member having an exit opening communicating with said latch slot, said entrance side member and said exit side member bridging said latch slot and connecting said upper portion and said lower portion together, said upper portion having a latch mount for mounting said latching member to said other of said first member and said second member so that said latch member is free to rotate in a plane parallel to said elongated, generally flat plate, said latch-engaging member mounted in said plane, and entering said entrance opening and engaging said slot in latched relation when said first member and said second member are moved toward each other against said bias, and disengaging from said slot and exiting through said exit opening when said bias is overcome.

2. A latch as set forth in claim 1 wherein said latch-engaging member further comprises a stub shaft.

3. A latch as set forth in claim 2 further comprising a camming edge along a lower edge of said lower portion, for bearing against said stub shaft and moving said latching member to a position wherein said stub shaft may enter said entrance opening and said slot.

4. A latch as set forth in claim 1 wherein said slot is a generally V-shaped slot having an entrance leg communicating with said entrance opening in said entrance side member and an exit leg communicating with said exit opening in said exit side member.

5. A latch as set forth in claim 4 wherein said V-shaped slot further comprises a generally rounded capture region between said entrance leg and said exit leg.

6. A latch as set forth in claim 5 wherein said latching member falls by gravity through said entrance opening onto said latch-engaging member so that said latch-engaging member is captured in said generally rounded capture region.

7. A latch as set forth in claim 6 wherein said latching member falls by gravity to move said generally rounded capture region away from said latch-engaging member so that said exit opening moves past said latch-engaging member to disengage said latch.

8. A latch as set forth in claim 5 wherein edges of said entrance leg and said exit leg on said upper portion are curved inward and upward, and edges of said entrance leg and exit leg on said lower portion are curved inward.

9. A latch as set forth in claim 5 wherein edges of said entrance leg on said upper portion and said lower portion are generally straight so that said slot initially moves onto said latch-engaging member in a direction normal to said side entrance member, and said edges of said entrance leg subsequently transition to angled, straight edges so that said latching member engages said latch-engaging member at said generally rounded capture region, with an edge of said exit leg on said upper portion being slightly curved upward so that said latching member falls away from said latch-engaging member with said latch-engaging member passing through said exit leg with a slightly curving motion.

10. A latch as set forth in claim 9 wherein said first member and said second member to be engaged in latched relation comprise support members for supporting a bobbin creel movable between an upright, operating position and a lowered position wherein a bobbin may be replaced, said latching member mounted to hang vertically generally above said latch-engaging member so that when said bobbin creel is lowered to said lower position, said latching member is moved to engage said latch-engaging member in a diagonal latched position wherein said latching member moves to engage said latch-engaging member in said generally rounded capture region, and when said bobbin creel is moved downward from a latched position, said latching member falls by gravity from said diagonal position, causing said generally rounded capture region to fall away from said latch-engaging member, with said exit leg and said exit opening passing said latch-engaging member.

11. A latch as set forth in claim 10 wherein said bobbin creel is mounted generally to a top of a cabling machine.

12. An automatic latching system comprising:

a cabling machine comprising a bobbin creel mounted above said cabling machine, said bobbin creel mounted to a bobbin creel support arm and movable between an upright, operating position and a lowered position wherein an empty bobbin may be replaced with a full bobbin, said bobbin creel biased to said upright position, a plurality of movable bobbin creel support members for movably supporting said bobbin creel and said bobbin creel support arm, a latch for latching said bobbin creel at said lowered position when said bobbin creel is pulled to said lowered position against a bias of said upright position, and for releasing said bobbin creel when a full bobbin is loaded onto said bobbin creel, said latch further comprising;

a latching member configured as an elongated, generally flat plate, said latching member having a generally V-shaped slot extending from one side of said generally flat plate to an opposite side of said generally flat plate, dividing said generally flat plate into an upper portion and a lower portion, a first side member having an entrance opening therein communicating with an entrance leg of said V-shaped slot, a second side member having an exit opening therein communicating with an exit leg of said V-shaped slot, said first side member and said second side member connecting said upper portion and said lower portion together, a capture region defined between said entrance leg and said exit leg, a lower edge of said lower portion configured as a camming surface, said upper portion of said latching member connected to an upper pivot of said bobbin creel support arm, said latching member being free to move in a plane parallel with said generally flat plate and being oriented vertically by gravity, a stub shaft mounted to a said support member connected to said bobbin creel support arm, said stub shaft in said plane parallel with said generally flat plate, whereby as said bobbin creel is lowered, said camming surface intersects said stub shaft, moving said latching member to a diagonal orientation so that said stub shaft moves relative to said latching member along said first side member, through said entrance opening and into said entrance slot, after which said bobbin creel is released, said bias trapping said stub shaft in said capture region, and when said full bobbin is loaded onto said bobbin creel, weight of said full bobbin overcomes said bias, allowing said latching member to swing from said diagonal orientation to a vertical orientation by gravity, causing said stub shaft to pass through said exit slot and out said exit opening, unlatching said bobbin creel.

13. An automatic latching system as set forth in claim 12 wherein said latching member falls straight onto said stub shaft, preventing further downward motion of said bobbin creel, and as said creel is released said latching member is biased upward so that said stub shaft is engaged in said capture region.

14. An automatic latching system as set forth in claim 13 wherein said exit leg is configured so that said latching member falls away from said stub shaft when a latched said assembly is moved downward against said bias.

15. A latch for automatically latching together and automatically releasing a first member and a second member supporting an assembly that is at least part of a fabrication process of a product, said assembly having an upper position and a lowered position, with a bias maintaining said assembly in an upper, operative position while allowing said assembly to be pulled against said bias to an automatically latched said lowered position where a consumable used in said fabrication process and held by said assembly may be replaced or renewed, said latch comprising;

a generally flat, elongated plate having a slot extending a width of said plate and dividing said plate into an upper portion and a lower portion, said slot having an entrance leg and an exit leg, with a capture portion between said entrance leg and said exit leg, said generally flat plate connected by a mount to a one of said first member and said second member that is above the other of said first member and said second member when said assembly is in said lowered position, said generally flat plate being free to rotate in a plane about said mount and hang in a vertical orientation, an entrance side member having a slot entrance opening communicating with said entrance leg and an exit side member having an exit opening communicating with said exit leg, said entrance side member bridging said entrance leg and said exit side member bridging said exit leg, connecting said upper portion and said lower portion together, a slot-engaging member mounted in said plane to said other of said first member and said second member, whereby when said consumable is depleted and said assembly is pulled to said lowered position against said bias, said latch is moved out of said vertical orientation by said slot-engaging member so that said slot engaging member rides along at least said entrance side member and enters said entrance opening and said entrance leg, after which said assembly is released and said bias causes said slot-engaging member to be captured in said capture portion, latching said assembly in said lowered position, and when said consumable is replaced or renewed, weight of replaced or renewed said consumable overcomes said bias and causes said assembly to drop, freeing said latch to rotate in said plane by gravity, causing said latch to free said slot-engaging member from said capture region and allow said latch to rotate so that said slot-engaging member moves through said exit leg and out said exit opening.

16. A latch as set forth in claim 15 wherein a lower edge of said lower portion comprises a camming surface to initially engage said slot-engaging member and move said latching member from said vertical orientation to a diagonal, latched orientation.

17. A latch as set forth in claim 15 wherein edges of said entrance leg are initially straight so that said latching member falls straight into said slot-engaging member, terminating downward movement of said assembly, with subsequent upward movement of said assembly capturing said slot-engaging member in said capture region.

18. A latch as set forth in claim 17 wherein edges of said exit leg are slightly curved so that said latching member smoothly falls away from said slot-engaging member as a latched said assembly is moved downward against said bias.

* * * * *